United States Patent [19]

Dyer

[11] 4,043,600

[45] Aug. 23, 1977

[54] ADJUSTABLE BUCKET FOR AN EARTH BORING MACHINE

[75] Inventor: Norman Dean Dyer, Beaumont, Tex.

[73] Assignee: Dresser Industries, Inc., Dallas, Tex.

[21] Appl. No.: 733,483

[22] Filed: Oct. 18, 1976

Related U.S. Application Data

[63] Continuation of Ser. No. 615,319, Sept. 22, 1975, abandoned, which is a continuation of Ser. No. 465,192, April 29, 1974, abandoned.

[51] Int. Cl.[2] ..... E21D 9/08

[52] U.S. Cl. ..... 299/33; 299/56; 299/67

[58] Field of Search ..... 299/31, 33, 56, 58, 299/85, 78, 67; 37/70, 189

[56] References Cited

U.S. PATENT DOCUMENTS

| | | | |
|---|---|---|---|
| 3,309,142 | 3/1967 | Winberg | 299/33 |
| 3,467,389 | 9/1969 | Bolotin et al. | 299/33 |

FOREIGN PATENT DOCUMENTS

| | | | |
|---|---|---|---|
| 9,549 | 4/1897 | United Kingdom | 299/56 |

*Primary Examiner*—Ernest R. Purser
*Assistant Examiner*—William F. Pate, III
*Attorney, Agent, or Firm*—Eddie E. Scott

[57] ABSTRACT

An earth boring machine is disclosed that produces a bore in a general axial direction relative to the longitudinal axis of the machine. A rotary head is mounted on the body of the earth boring machine and cutter means on the rotary head contact the face of the bore and loosen material at the face of the bore. The loosened material falls to the bottom of the bore. Buckets positioned on the rotary head are located at a first radial distance from the longitudinal axis of the machine to pick up the loose material at the bottom of the bore. As the rotary head rotates, the buckets are carrried above the bottom of the bore and the buckets are moved to a second and shorter radial distance from the longitudinal axis of the machine to prevent the buckets from interfering with elements of the machine near the roof of the bore.

3 Claims, 6 Drawing Figures

ADJUSTABLE BUCKET FOR AN EARTH BORING MACHINE

This is a continuation of application Ser. No. 615,319, filed Sept. 22, 1975, now abandoned, which was a continuation of application Ser. No. 465,192, filed Apr. 29, 1974, now abandoned.

BACKGROUND OF THE INVENTION

This invention relates to the art of earth boring and more particularly to an earth boring machine that produces a bore in earth formations by loosening portions of the formations at the face of the bore.

This type of earth boring machine is characterized by a rotary head connected to the body of the machine that includes cutters for contacting the face of the bore and loosening material at the face of the bore. The loosened material falls to the bottom of the bore where it accumulates and must be picked up for removal. Conventionally, buckets attached to the rotary head scoop up the loosened material and transfer it to a conveyer and/or other equipment for removing it from the bore. The buckets should be in a position proximate the bottom wall of the bore when they are scooping up the loosened material. At other locations throughout the rotation of the rotary head, the buckets need not be proximate the wall of the bore.

Under some circumstances it is undesirable for the buckets to remain proximate the wall of the bore throughout the rotation of the rotary head. For example, when boring through caving formations, it is desirable to provide a shield above the machine to prevent the caving materials from falling onto the machine. The shield should extend to a point near the rotary head. If the buckets are proximate the wall of the bore in the vicinity of the shield, the shield must be spaced from the rotary head. This allows portions of the caving material to fall onto the machine through the space between the rotary head and the shield.

It will be appreciated that it may be desirable to have the buckets positioned at a shorter radial distance from the central axis of the rotary head during a portion of the cutterhead's rotational cycle to prevent the buckets from interfering with elements other than the previously mentioned shield. Space is extremely valuable on an earth boring machine and available space is needed for elements of the earth boring machine or companion equipment. For example, lining systems are often used in conjunction with tunneling machines, and it may be desirable to place some of the elements of the lining system close to the rotary head.

DESCRIPTION OF PRIOR ART

In U.S. Pat. No. 1,371,224 to L. W. Campbell patented Mar. 15, 1921, a tunneling machine is shown. The tunneling machine comprises a cutterhead rotatable about a substantially horizontal axis for loosening material at the face of the cut, means for picking up the loosened material which falls to the bottom of the bore, means for causing said pick up member to travel in a definite path at the bottom of said bore, and means whereby the path of said pick up member at the bottom of said bore may be varied to enable it to be used with tunnels having bores of different dimensions.

In U.S. Pat. No, 1,462,997 to L. W. Anderson patented July 24, 1923, a tunneling machine is shown. The tunneling machine comprises a rotatable boring head for freeing the material and a pick up mechanism for picking up the freed material from the bottom of the bore. The pick up mechanism comprises a central rotatable receiving chamber to which the material is to be delivered, a chute having a quick-detachable connection with respect to said rotatable central chamber, and a pick-up bucket adjustably secured to said chute.

In U.S. Pat. No. 3,232,670 to R. J. Robins et al patented Feb. 1, 1966, a tunnel-boring rotary head with adjustably mounted gage cutters is shown. A large circular head is mounted at the front of the body of the machine for rotary motion about the longitudinal axis of the machine. The head is powered for rotary motion and for progressive axial motion in the intervals between the steps of travel. The head carries a plurality of outrigger bucket members which are or may be evenly spaced along the circumference of the head. Cutters are mounted on the front face plate and also on the outrigger bucket members. As the head rotates and at the same time advances, the bucket members follow a spiral path along the circumference of the end wall of the tunnel and act to scoop up rock and other debris cut by the cutters from such end wall. The buckets carry the debris to the top of the machine. There the contents of the buckets discharge by gravity onto an endless conveyer which carries the debris to the rear of the machine. The outrigger buckets are hinged and may be selectively swung inward for servicing.

SUMMARY OF THE INVENTION

The present invention is incorporated in an earth boring machine that produces a bore by loosening material at the face of the bore. The loosened material falls to the bottom of the bore where it must be picked up and removed. The machine includes a rotary head connected to the machine body. Cutter means on the rotary head contact the face of the bore and loosen material at the face of the bore. At least one bucket is connected to the rotary head for picking up the loose material that has fallen to the bottom of the bore. Means are included for positioning the bucket at a first radial distance from the central axis of the rotary head when the bucket is in a first position picking up the loose material at the bottom of the bore and for positioning the bucket at a second and shorter radial distance from the central axis of the rotary head when the bucket is in a second position spaced from said first position. The above and other features and advantages of the present invention will become apparent from a consideration of the following detailed description of the invention when taken in conjunction with the drawings.

BREIF DESCRIPTION OF THE DRAWINGS

DETAILED DESCRIPTION OF THE INVENTION

Figure 1:
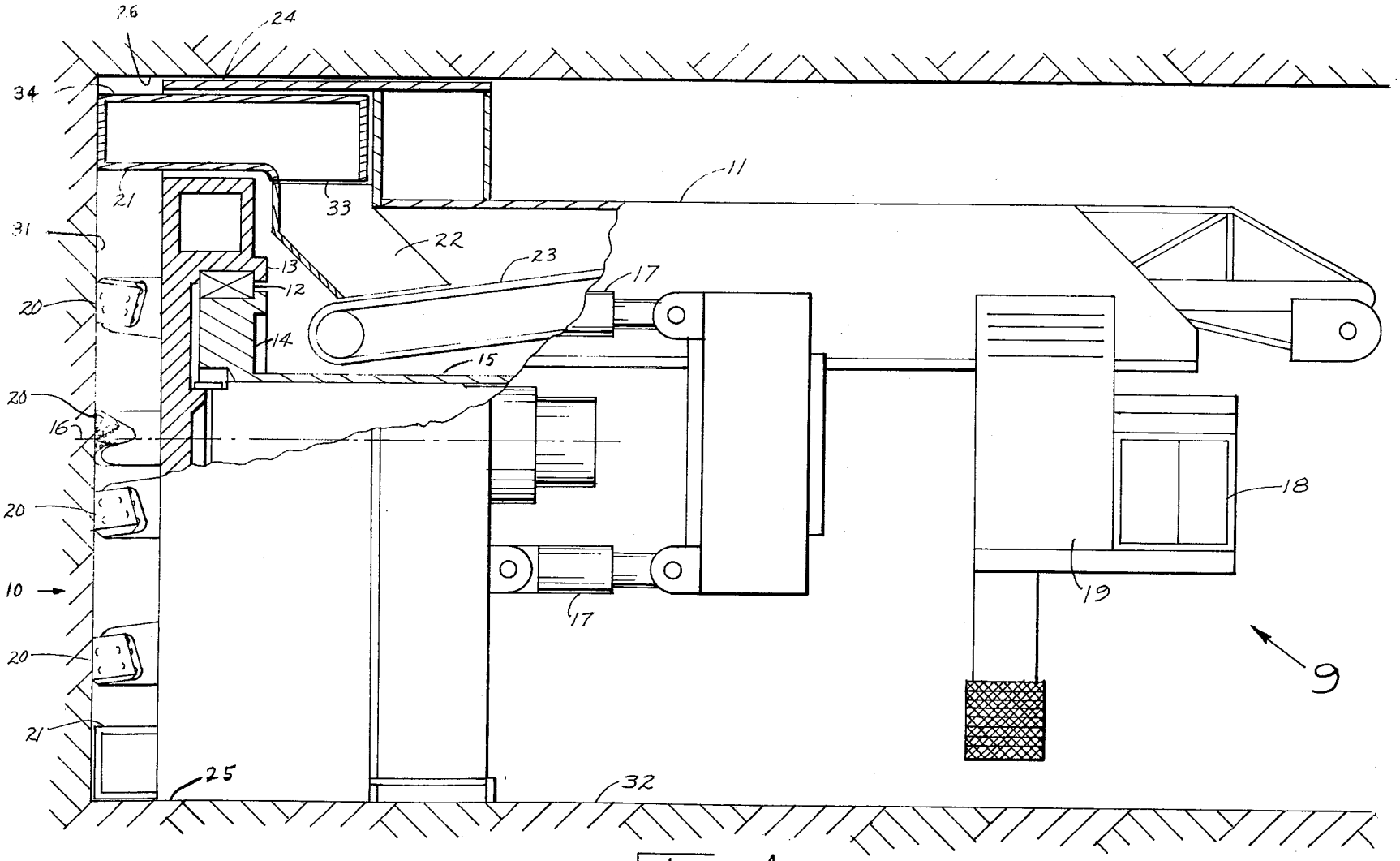
FIG. 1 shows a side view of an earth boring machine incorporating the present invention.

Referring now to the drawings and in particular to FIG. 1, a side view of an earth boring machine generally designated by the reference number 9 is shown. The earth boring machine 9 generally comprises a cutterhead assembly 10 and a main body portion 11. The cutterhead assembly 10 is rotatably mounted on the body portion 11 by means of a bearing assembly 12 located between a rearward extension 13 on the cutterhead assembly 10 and a mating hub 14 on a cutterhead support assembly 15 connected to the main body portion 11. The cutterhead assembly 10 is rotated by a power unit in the main body portion 11 and rotates about a central axis 16. The cutterhead assembly 10 includes a multiplicity of rolling cutters 20 that contact and disintegrate the formations at the face 31 of the bore 32. Hydraulic cylinder assemblies 17 force the cutterhead assembly 10 toward the face of the bore 31 maintaining sufficient contact force between the rolling cutters 20 and the formations to be disintegrated. The portions of the formations broken away from the face 31 fall to the bottom of the bore 32 where they accumulate and must be picked up for removal.

Figure 2:
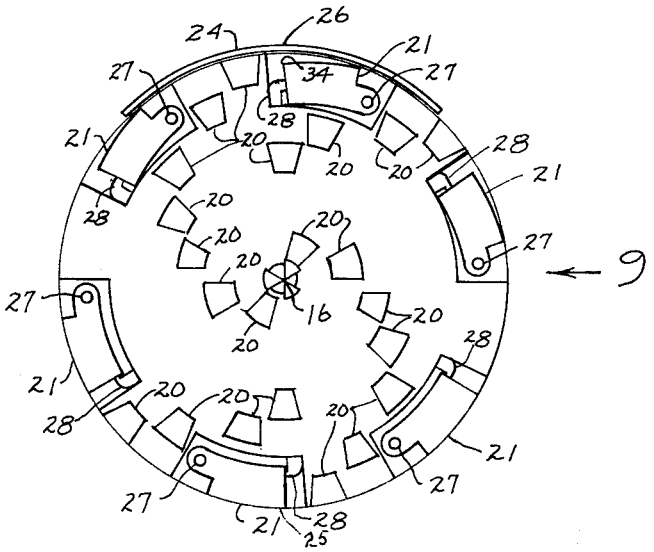
FIG. 2 is a front view of the machine shown in FIG. 1.

Referring now to FIGS. 1 and 2, the removal of the debris from the earth boring operation will be considered. As the cutterhead assembly 10 rotates, buckets 21 on the cutterhead assembly 10 scoop up the drilling debris from the bottom of the bore 32 and carry it to the top of the bore where it is emptied into a chute 22 and falls onto an endless belt conveyer 23. When a bucket 21 is in a position near the top of the bore 32, gravity carries the drilling debris through the opening 33 in the bucket 21 into the chute 22. The chute 22 directs the debris onto the endless belt conveyer 23 wherein it is transported to the back of the earth boring machine 9 for removal. Control and power equipment for the earth boring machine is located in housing 19 and cab 18.

Many of the formations encountered during the earth boring operation tend to cave onto the earth boring machine 9. In order to retard the caving, a shield 24 is positioned at the top of the bore 32. The shield 24 prevents caving materials from falling into the spaces between the buckets and into the space between the rotating cutterhead assembly 10 and the main body 11. Conventional means, such as rock bolts and ring braces may be used to support the formations in back of the shield 24. In order to effectively pick up the drilling debris at the bottom of the bore 32, the buckets 21 should extend a first radial distance from the central axis 16 of the cutterhead assembly 10. This first distance is the distance from the central axis 16 of the cutterhead assembly 10 to a point 25 at the bottom of the bore. When the bucket 21 is near the top of the bore 32, the shield 24 prevents the bucket 21 from extending said first distance from the central axis 16 of the cutterhead assembly 10. For example, if the buckets 21 extend to point 26 at the top of the bore 32, they would contact the shield 24. The buckets 21 may only extend a second and shorter distance from the central axis 16 of the cutterhead 10. The second distance is the distance from the central axis 16 of the cutterhead assembly 10 to the outermost point 34 on the bucket 21.

Figure 3:
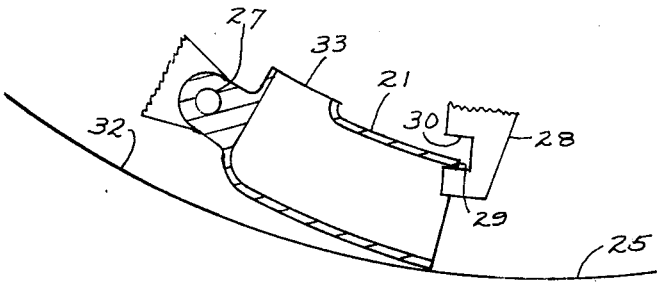
FIG. 3 shows the position of a bucket at the bottom of the bore.

Referring now to FIG. 3, a partial view of a bucket 21 is shown near the bottom of the bore 32. The bucket 21 is connected to the cutterhead assembly 10 by a hinge 27. The lip 29 of the bucket 21 fits within a gap 30 in a bucket support element 28. Gravity keeps the lip 29 of the bucket 21 at the outer end of the gap 30 when the bucket 21 is near the bottom of the bore 32. This insures that the bucket 21 will extend said first radial distance from the central axis 16 of the cutterhead assembly 10 when the bucket is scooping up debris.

Figure 4:
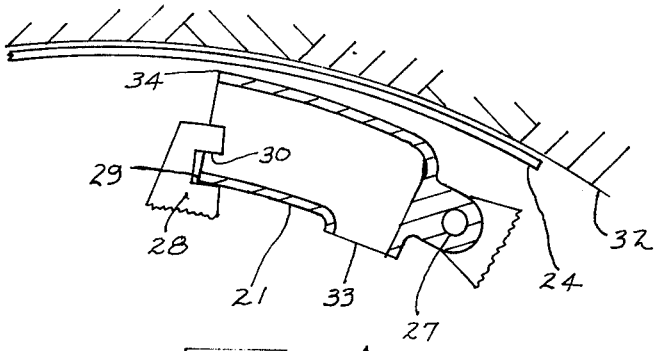
FIG. 4 shows the position of a bucket at the top of the bore.

Referring now to FIG. 4, the bucket 21 is shown near the top of the bore 32. The bucket 21 must clear the shield 24. Gravity has forced the bucket 21 to rotate a short distance on hinge 27. The lip 29 of the bucket 21 has moved from the outer end of the gap 30 to the inner end of the gap 30. Any debris in the bucket 21 will be discharged through the opening 33.

The structural details of an earth boring machine constructed in accordance with the present invention having been described, operation of the earth boring machine 9 will now be considered. The main body 11 of the earth boring machine is locked to the bore 32 by retractable grippers or other conventional means (not shown). The hydraulic cylinder assemblies 17 are extended to urge the cutterhead assembly 10 against the face 31 of the bore 32. Simultaneously, the cutterhead assembly 10 is rotated whereupon the cutters 20 disintegrate the formations causing drilling debris to fall to the bottom of the bore 32. The buckets 21 scrape the invert of the bore 32 as they pass along the bottom of their arc of travel and collect the drilling debris that has accumulated at the bottom of the bore 32. The lips 29 of the buckets 21 are at the outer ends of the gaps 30 in the bucket support elements 28. The cutterhead assembly 21 continues to rotate carrying the buckets 21 and the debris upward until gravity causes the lips 29 of the buckets 21 to move to the inner ends of the gaps 30 in the bucket support elements 28. The buckets 21 are moved inward toward the central axis 16 of the cutterhead assembly 10 and the buckets will clear a shield or other machine element positioned proximate the top of the bore. When the buckets 21 reach the top of their arc of travel they dump the drilling debris into the chute 22. The drilling debris falls onto the endless belt conveyer 23 and is carried to the rear of the earth boring machine 9 for removal.

Figure 5:
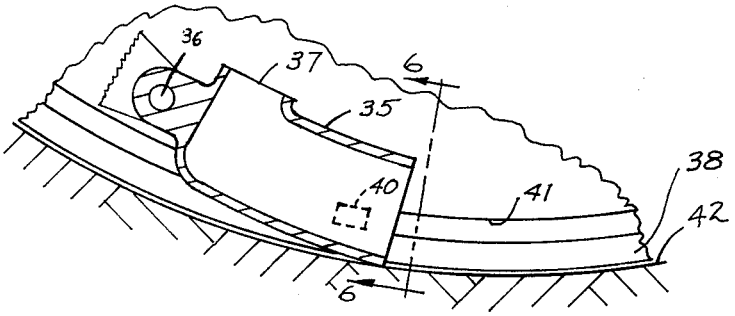
FIG. 5 shows another embodiment of a bucket of the present invention.
Figure 6:
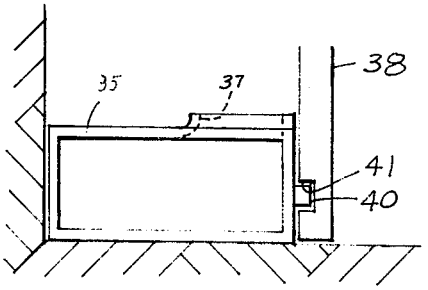
FIG. 6 is an end view of the bucket shown in FIG. 5.

Referring now to FIGS. 5 and 6, another embodiment of the present invention is shown. This embodiment utilizes a cam element 40 that travels in a track 41 to position the bucket 35 proximate the invert of the bore to scoop up drilling debris and to position the bucket 35 inward at other portions of the rotational cycle of the cutterhead assembly. The track 41 is a groove located in a dust shield 38 attached to the main body unit of the earth boring machine. The bucket 35 is attached to the cutterhead assembly by a hinge 36. The position of the cam element 40 in track 41 relative to the central axis of the cutterhead assembly and the wall 42 of the bore determines the position of the bucket 35. The track 41 is nearer the central axis of the cutterhead assembly at locations above the invert. When the bucket 35 reaches the top of the bore, the debris picked up by the bucket will be discharged through the opening 37 for removal. The cam element 40 will have moved the bucket 35 inward and the bucket will not interfere with elements of the earth boring machine located near the wall 42 of the bore.

The embodiments of the invention in which an exclusive property or privilege is claimed are defined as follows:

1. An earth boring machine for producing a bore by loosening material at the face of the bore wherein the loosened material falls to the bottom of the bore, comprising:

a machine body;

a rotary head connected to said machine body, said rotary head having a central axis;

cutter means on said rotary head for loosening material at the face of the bore;

a shield positioned over said machine body extending proximate said rotary head, said shield located at a first radial distance from the central axis of said rotary head;

at least one bucket connected to said rotary head for picking up the loosened material at the bottom of the bore; and positioning means for positioning said bucket substantially at said first radial distance from the central axis of said rotary head when said bucket is in a first position picking up the loosened material at the bottom of the bore and for positioning said bucket at a second and shorter radial distance from the central axis of said rotary head when said bucket is in a second position spaced from said first position, said positioning means including track means in said machine body proximate said cutterhead, means connected to said bucket for traveling in said track means and hinge means between said bucket and said rotary head.

2. In an earth boring machine for producing a bore in earth formations by breaking away portions of the formations causing the portions of the formations to fall to the bottom of the bore, said machine including a body portion and a rotary head that rotates about a central axis, the improvement comprising:

a shield positioned above the bottom of the bore over said body portion of the machine extending proximate said rotary head, said shield located at a first radial distance from the central axis of said rotary head;

a bucket positioned on said rotary head to rotate with said rotary head from a position above the bottom of the bore to a position proximate the bottom of the bore to a position above the bottom of the bore for picking up said portions of the formations at the bottom of the bore; and means for locating said bucket at substantially said first radial distance from said central axis when said bucket is in said position proximate the bottom of the bore and locating said bucket at a second and shorter radial distance from said central axis when said bucket is in said position above the bottom of the bore, said means comprising a hinge between said bucket and said rotary head, said means including track means in said body portion of said machine for locating said bucket at said first and second radial distances, a cam means connected to said bucket for traveling in said track and a hinge between said bucket and said rotary head.

3. An earth boring machine for producing a bore by loosening material at the face of the bore wherein the loosened material falls to the bottom of the bore, comprising:

a machine body;

a rotary head connected to said machine body, said rotary head having a central axis;

cutter means on said rotary head for loosening material at the face of the bore;

a shield positioned above the bottom of the bore over said machine body extending proximate said rotary head, said shield located at a first radial distance from the central axis of said rotary head;

a multiplicity of buckets connected to said rotary head for picking up the loosened material at the bottom of the bore; and positioning means for locating said buckets at substantially said first radial distance from the central axis of said rotary head when said buckets are proximate the bottom of the bore and locating said buckets at a second and substantially shorter radial distance from the central axis of said rotary head when said buckets are proximate said shield to allow said buckets to clear said shield, said positioning means including track means in said machine body proximate said rotary head for locating said buckets at said respective first and second radial distances, cams connected to said buckets that travel in said track means and hinge means between said buckets and said rotary head.

* * * * *